US010549941B2

(12) United States Patent
Chuah

(10) Patent No.: US 10,549,941 B2
(45) Date of Patent: Feb. 4, 2020

(54) HAND HELD ELECTRIC TAPE DISPENSER

(71) Applicant: Khai Gan Chuah, Austin, TX (US)

(72) Inventor: Khai Gan Chuah, Austin, TX (US)

( * ) Notice: Subject to any disclaimer, the term of this patent is extended or adjusted under 35 U.S.C. 154(b) by 48 days.

(21) Appl. No.: 15/297,046

(22) Filed: Oct. 18, 2016

(65) Prior Publication Data

US 2018/0105385 A1 Apr. 19, 2018

(51) Int. Cl.
*B65H 35/00* (2006.01)

(52) U.S. Cl.
CPC ..... *B65H 35/0026* (2013.01); *B65H 2403/92* (2013.01); *B65H 2553/00* (2013.01); *B65H 2555/20* (2013.01)

(58) Field of Classification Search
CPC ..... B65H 35/002; B65H 35/0026; B65H 35/0033; B65H 35/0086; B65H 2551/14; B65H 2551/15; B65H 2301/51532; B65H 2301/51541; B65H 2403/92; B65H 2553/25; Y10T 225/202; Y10T 83/896
See application file for complete search history.

(56) References Cited

U.S. PATENT DOCUMENTS 3,650,097 A * 3/1972 Nokes ..... A01B 69/008 180/204
3,730,409 A * 5/1973 Ratti ..... A47K 10/36 225/14
3,802,309 A * 4/1974 Bosland ..... B65H 35/002 83/176
4,407,692 A * 10/1983 Torbeck ..... B41J 2/32 101/288
5,579,669 A * 12/1996 Kind ..... A23G 3/563 242/588.6
6,386,415 B1 * 5/2002 Tsai ..... B65H 35/0026 225/11
7,121,499 B2 * 10/2006 Lammers ..... B26F 3/02 242/588.6
8,066,045 B2 * 11/2011 Sleiman ..... B65C 11/004 156/351
2002/0121169 A1 * 9/2002 LeMoine ..... B26D 7/22 83/38
2005/0077336 A1 * 4/2005 Lammers ..... B26F 3/02 225/51

* cited by examiner

*Primary Examiner* — Jennifer B Swinney
(74) *Attorney, Agent, or Firm* — Craige Thompson; Thompson Patent Law; Vincent Musgrove

(57) ABSTRACT

The present invention is to provide a power tape dispenser which capable to automatically dispense and cut packaging tape at a desired speed. The operations of the tape dispenser such as taping and cutting process are controlled by the engagement of surface triggering device, the main triggering device and the electrical components.

21 Claims, 7 Drawing Sheets

| Present State | Inputs 43a | 43b | 43t | Next State | Output (Y) |
|---|---|---|---|---|---|
| C_OFF | 0 | 0 | 0 | C_OFF | 0 |
| C_OFF | 1 | 1 | 0 | C_READY | 0 |
| C_READY | 1 | 0 | 0 | C_ON | 1 |
| C_READY | 0 | 1 | 0 | C_ON | 1 |
| C_ON | x | x | 0 | C_ON | 1 |
| C_ON | x | x | 1 | C_OFF | 0 |

HAND HELD ELECTRIC TAPE DISPENSER

BACKGROUND OF THE INVENTION

Field of the Invention

This invention relates to an auto tape dispenser powered electronically with means to dispense and cut tape at a desired speed.

Discussion of Prior Art

The current tape dispensers being used today are descendants of the prior art U.S. Pat. No. 5,236,540A which consists of taping device including to rotatable member supported on a frame for supporting a tape, a rotatable roller supported on the frame, a presser including a handle extended downward through a slot formed in the bottom of the frame and including a panel engageable with the roller, and a resilient element for biasing the panel of the presser toward the roller so as to retain the tape in place, the panel can be separated from the roller when the handle of the presser is pulled against the resilient element.

One of the main problem of current hand held tape dispenser is that it requires human strength to stretch and pull the tape into variable lengths prior to asserting the cutter manually. In present invention, the electronic tape dispenser utilizes electric motor to dispense the tape upon activation by the user. The user will simply place the electric hand held tape dispenser on the desire location and the moving roller powered by an electric motor will guide the tape dispenser into the direction guided by the hand of the user. It saves time and minimizes work strain injuries imposed on hand and wrist of workers, due to long hours of packing items at warehouses. It increases speed and efficiency of workers compared to using traditional hand held tape dispenser, thereby increases productivity of workers. Electronic cutting of the tape in combination wilt the speed adjustment of the tape dispensing can result in a more precise and accurate dispensing.

SUMMARY OF INVENTION

The present invention is to provide a power tape dispenser which capable to automatically dispense and cut packaging tape. The operations of the tape dispenser such as taping and cutting process are controlled by the engagement of surface triggering device and the twain triggering device. The surface triggering device of present inventions includes but not limited to standby roller, lever, main roller, and proximity sensor. The main triggering device of present invention includes but not limited to push button. In one embodiment, the standby roller is the surface triggering device. During the taping process, the user places tape dispenser on the surface of an object such as a carton box. The pressure asserted on tape dispenser will result in the standby roller retracted and urged into a position against the spring and eventually its conductive plate comes into contact with the conductive plates of the switch and closes the first portion of tape dispenser's circuitry. The user then engages the main triggering device such as push button located on the shaft of the handle to further close the second portion of the tape dispenser circuitry forming a complete circuit. Powered by battery, the electric motor activates and rotates its gears at the gear component, which drives the main roller to pull the tape from the adapter roller. The adapter roller can be also be driven by motor to rotate and dispense tape. In this case, it can lessen the work needed to dispense the tape as the tension force is distributed between two rotating components. In another embodiment, lever is the surface triggering device. When the lever is in contact with the surface of an object, both lever and the conductive holder rotate and eventually its conductive plate comes into contact with the conductive plates of the switch, and close the first portion of tape dispenser's circuitry. In another embodiment, main roller is the surface triggering device. The primary means of the main roller is to guide and press the tape on to a surface as it is dispensing. During the taping process, the user places tape dispenser on the surface of an object. The pressure asserted on tape dispenser will load tension on the spring and result in the main roller to be retracted and urged into a position against the spring Eventually its conductive plate comes into contact with the conductive plates of the switch, closing the first portion of tape dispenser's circuitry. In another embodiment, proximity sensor is the surface triggering device. When the sensor of tape dispenser is in within specific range to target object, a detection of object surface by the proximity sensor will activate the electrical switch into "ON" position and close the first portion of tape dispenser's electric circuitry. It is to be noted that the surface triggering device and the main triggering device can be part of the electrical switch as one entity.

It is to be understood that the invention is not limited in its application to the details of construction and the arrangement of the components set forth in the following description and illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF INVENTION

Figure 1:
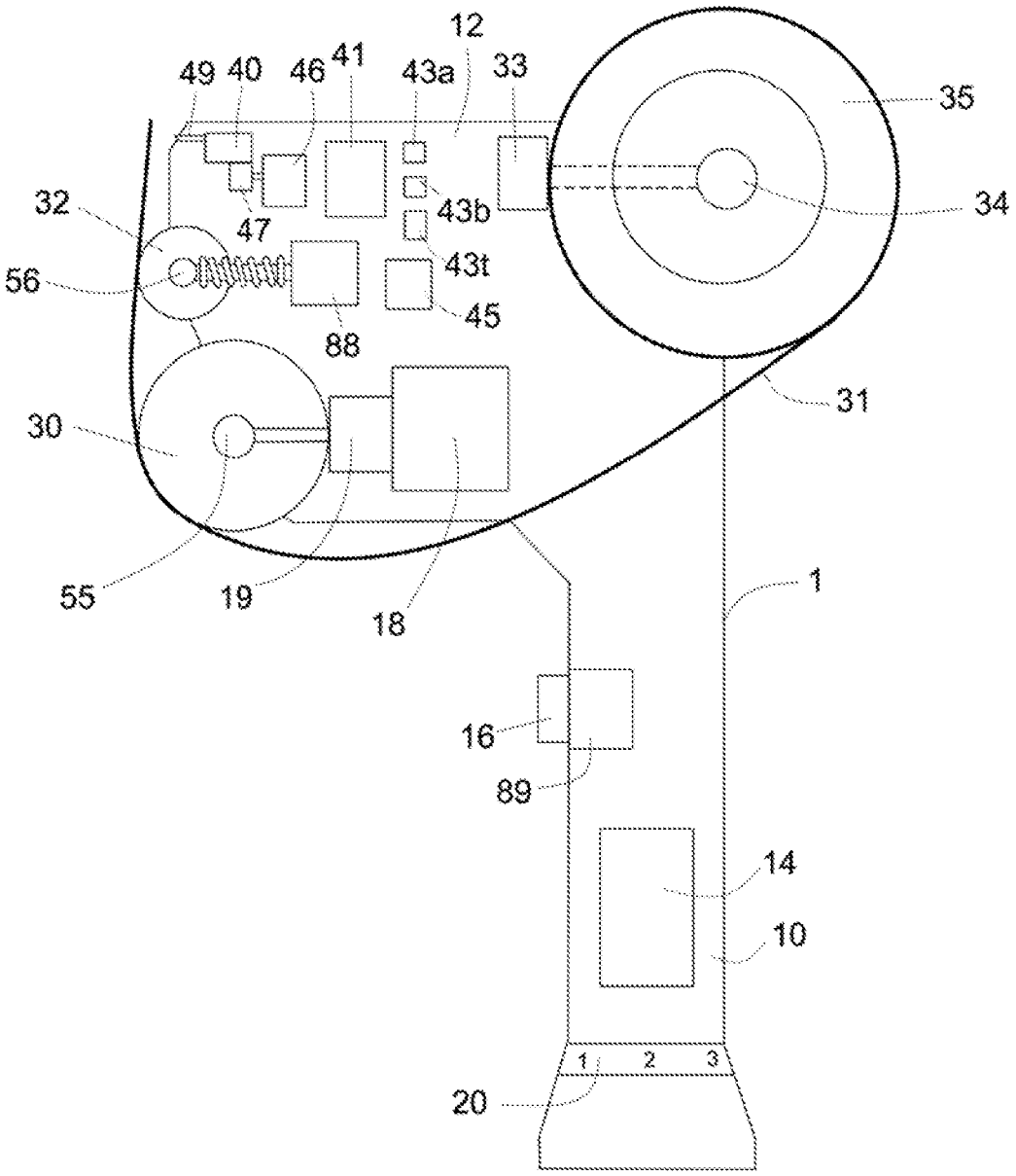
FIG. 1 is a schematic diagram of the tape dispenser according to an embodiment of present invention with its outer housing removed.

The present invention is an electric hand held tape dispenser 1 (see FIG. 1) consisting of a handle 10 and a frame 12 mounted into and above said handle 10. The outer casings (not shown in figures) of handle 10 and frame 12 have been removed to expose the internal structure. The handle 10 is of a shaft shape, proper for hand grip, and houses a battery 14, push button 16, speed controller 20. The handle can also house electronic circuit boards, switches, electric motors and gear components if deem more efficient. The main structure of the frame 12 consists of a main roller 30, adapter roller 35, standby roller 32, cutter 40, switches, electronic circuit boards, electric motors and gear components. The handle 10 and frame 12 can be of various designs, sizes and shapes with the intent to secure the components of tape dispenser 1. The function of the electric motor 18 and gear component 19 is to drive the main roller 30 of the tape at a desired speed. The primary means of the main roller 30 is to guide and press the tape 31 on to a surface as it is dispensing. The main roller 30 is a wheel component connected to the gear component 19 by the axle 55. It is to be noted the wires of all electric components are not shown in all figures.

The adapter miler 35 is mounted on a shaft 34 and rotates about the shaft 34 while supporting a roll of tape 31 thereon. The adapter roller 35 is driven by its motor 33 to rotate and thus, dispenses the tape 31. In this case, it can lessen the work needed to dispense the tape as the tension three is distributed between two rotating components. The speed of adapter roller 35 and main roller 30 is preferred to be in synchronized and the rotation speed is optionally adjusted by the speed controller 20. Alternatively, the motion of tape dispenser 1 may vary slightly such that the main roller 30 is slightly faster than the adapter roller 35 to create a constant tension of tape. In this case, it will prevent the tape from sagging in between the tape adapter and the main roller. Optionally, the tape dispenser 1 can be equipped with a simple mechanical adapter roller without being driven by a motor. In this case, the adapter roller rotates passively since the work of pulling the tape 31 falls solely on the main roller 30. The speed controller 20 is a circuit device that controls the speed of motors. The main roller motor 18 and adapter roller motor 33 are connected to the speed controller 20 with means to run the dispenser at a desired speed. The speed controller 20 depicted in FIG. 1 may have several settings such as level 1, level 2, or level 3 to speed up or slow down the rotation speed of either one or both of the said rollers to dispense the tape.

The circuit of tape dispenser 1 is controlled by electrical switches. The first portion of circuitry composes of a surface triggering device and its related switch component 88. In this embodiment, the standby roller 32 is the surface triggering device. The second portion of circuitry composes of main triggering device and its related switch component 89. In this embodiment, the push button 16 is the main triggering device. In order to activate the motors of the tape dispenser 1, both switch 88 and switch 89 must be turned "ON" to form a complete circuit.

The standby roller 32 is a tension loaded wheel component connected to the switch component 88 by the axle 56. One end of standby roller 32 has a conductive plate that further interacts with an electrical switch 88. The switch 88 takes part in controlling the flow of power from battery 14 (power supply) to all respected motors. During the taping process, the user places tape dispenser 1 on the Surface of an object such as a carton box. The pressure asserted on tape dispenser 1 will result in the roller 32 retracted and urged into a position against the spring and eventually its conductive plate comes into contact with the conductive plates of the switch 88, it closes the first portion of circuitry (switch 88 is in "ON" position). In this case, the tape dispenser 1 is in standby mode. The user then engages the push button 16 located on the shaft of the handle. This, in turn, activates the switch 89 to form a complete circuit. When both switches (switch 88 and switch 89) of the are set to "ON" position, powered by battery 14, electric motor 18 activates and rotates its gears at the gear component 19, which drives the main roller 30 to pull the tape from the adapter roller 35. While the push button 16 remains depressed, if the standby roller 32 is no longer in contact with the surface of an object, the spring automatically returns the standby roller 32 to its initial "unpressed" position (switch 88 is in "OFF" position) forming an open circuit and causes the motion of the motor 18 to stop. Conversely, if the user releases the push button 16 while the standby roller 32 is still in contact with the surface of an object, the motor 18 will stop as well. The said dual-switch circuit ensures the electric components such as motor 18 will not turn on unexpectedly when the user accidentally triggers the switch of either standby roller 32 or push button 16. The push button 16 is optimally place along the shaft of the handle so that it is at a position where it can be easily activated and deactivated by the finger of the hand of the user gripping the handle. The standby roller 32 or push button 16 can be of various designs, sizes and shapes (such as knob, tab, stub, lever, disk or button) as long as it causes the switch to turn on and off. It is to be noted that the standby roller 32 or push button 16 can also be part of the electrical switch as one entity. It is to be noted that the spring mentioned throughout the invention can be replaced with any form of tension-loaded device with means toggle between loaded and of pressures.

When the desired length of tape is dispensed, the tape 31 can be cut off by a powered cutter 40 with blade 49. When cutter circuit controller 41 is set to "ON" position, electric motor 46 is activated to rotate its gears at the gear component 47, which activates the cutter 40. The operation of cutter 40 is managed by cutter circuit controller 41. The inputs of cutter circuit controller 41 are connected to contact 43*a*, contact 43*b* and contact 43*t* respectively. Contact 43*a* is further connected to switch 88 of the standby roller 32. Contact 43*b* is connected to the switch 89 of the push button 16. Contact 43*t* is connected to timer 45, a digital counter which counts down from a specified time. The output of the circuit controller 41 is connected to the motor 46 of cutter 40.

The cutter 40 is activated under one of the following conditions: a) When the tape dispenser 1 is lifted away from the target object while push button 16 remains depressed by the user, switch 88 is in "OFF" position and switch 89 is in "ON" position. b) When the tape dispenser 1 remains in contact with the target and push button 16 is released by the user, switch 88 is in "ON" position and switch 89 is in "OFF" position.

Figures 2A, 2B:
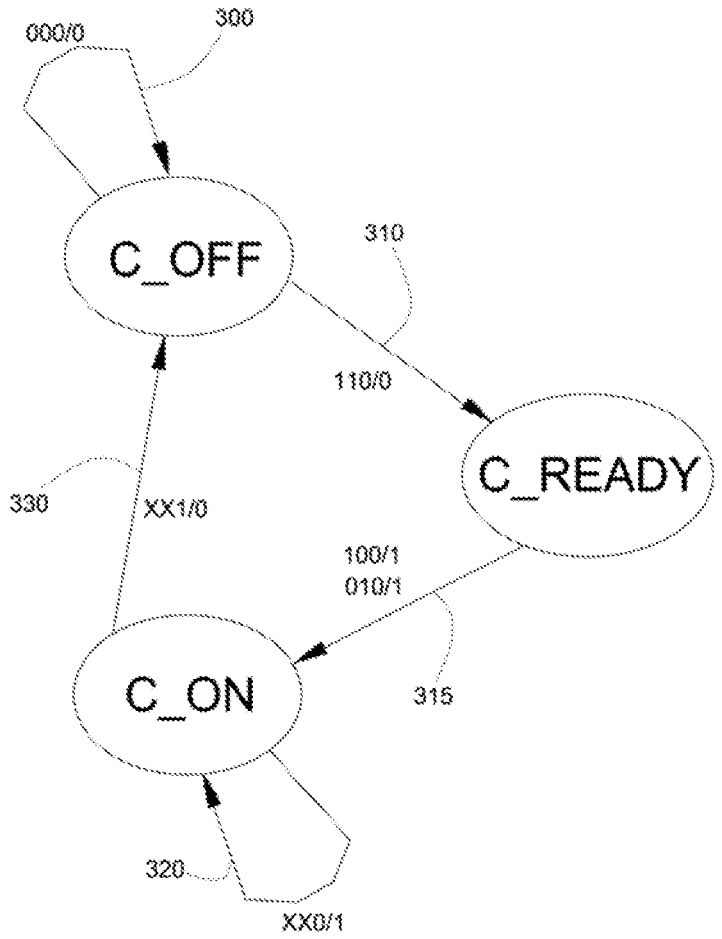
FIG. 2*a* illustrates a state diagram correspond to cutter circuit controller of present invention.
FIG. 2*b* illustrates a state table correspond to cutter circuit controller of present invention.

The above scenario can be illustrated by the cutter circuit controller state diagram (see FIG. 2*a*). An edge represents the transition from one state to another as caused by the inputs (43*a*, 43*b*, 43*t*). An edge is depicted as an arrow directed from the present state to the next state. The cutter circuit controller 41 has three states: C_OFF, C_READY and C_ON, The cutter circuit controller 41 state machine can be represented by a state diagram (FIG. 2*a*) and state transition table (FIG. 2*b*), showing the next state and the output Y (action) resulting from each input. When the dispenser 1 is inactive, the inputs 43*a*=0, 43*b*=0, 43*t*–0, output Y=0 (Edge 300) and the cutter circuit controller 41 remains in state C_OFF. When the tape dispenser 1 is in operation, the inputs become 43*a*=1, 43*b*=1, 43*t*=0, output Y=0 (Edge 310). The cutter circuit controller 41 will trigger the transition to C_READY state. At this state, the cutter circuit controller 41 is in standby mode ready to turn on the cutter 40. It is noted that, at C_READY state, the cutter 40 is not activated. This is to make sure the cutter 40 will not cut off tape 31 abruptly while tape dispenser is still running. When the inputs are 43*a*=1, 43*b*=0, 43*t*=0 or 43*a*=0, 43*b*=1, 43*t*=0, output Y=1 (Edge 315), the state of cutter circuit controller 41 transitions from C_READY state to C_ON state. At this state cutter circuit controller 41 turns on the cutter 40, and tape 31 is subsequently being cut off by blade 49 of cutter 40. At C_ON state, cutter circuit controller 41 also triggers the timer 45. The cutter circuit controller 41 will stay at C_ON state as long as 43*t*=0 (Edge 320). The timer 45 will set input 43*t*=1 at a specific time. When the specific time has been reached, the inputs are 43*a*=X (don't care), 43*b*=X (don't care), 43*t*=1. The cutter circuit controller 41 transitions from C_ON state to C_OFF state (Edge 330) with output Y=0. At C_OFF state the operation of cutter 40 is stopped and the state machine of cutter circuit controller 41 resets to its original state.

The cutter 40 and its related components can be located at any location of the tape dispenser 1 with means to cut the tape to be included in to all the embodiments. It is noted that, the components of cutter 40 can be of various designs, sizes and shape. The motor 46 of cutter 40 can also connect directly to a push button switch. In this case, the user can activate the cutter 40 by depress the push button or deactivate the cutter 40 by releasing the push button. Alternatively, the tape dispenser 1 can be equipped with a simple mechanical cutter without being driven by motor. The process can be accomplished using non-motorized systems such as, but not limited to the spring mechanism. The above features of cutter 40 can be included into all embodiments of the present invention.

Figure 3:
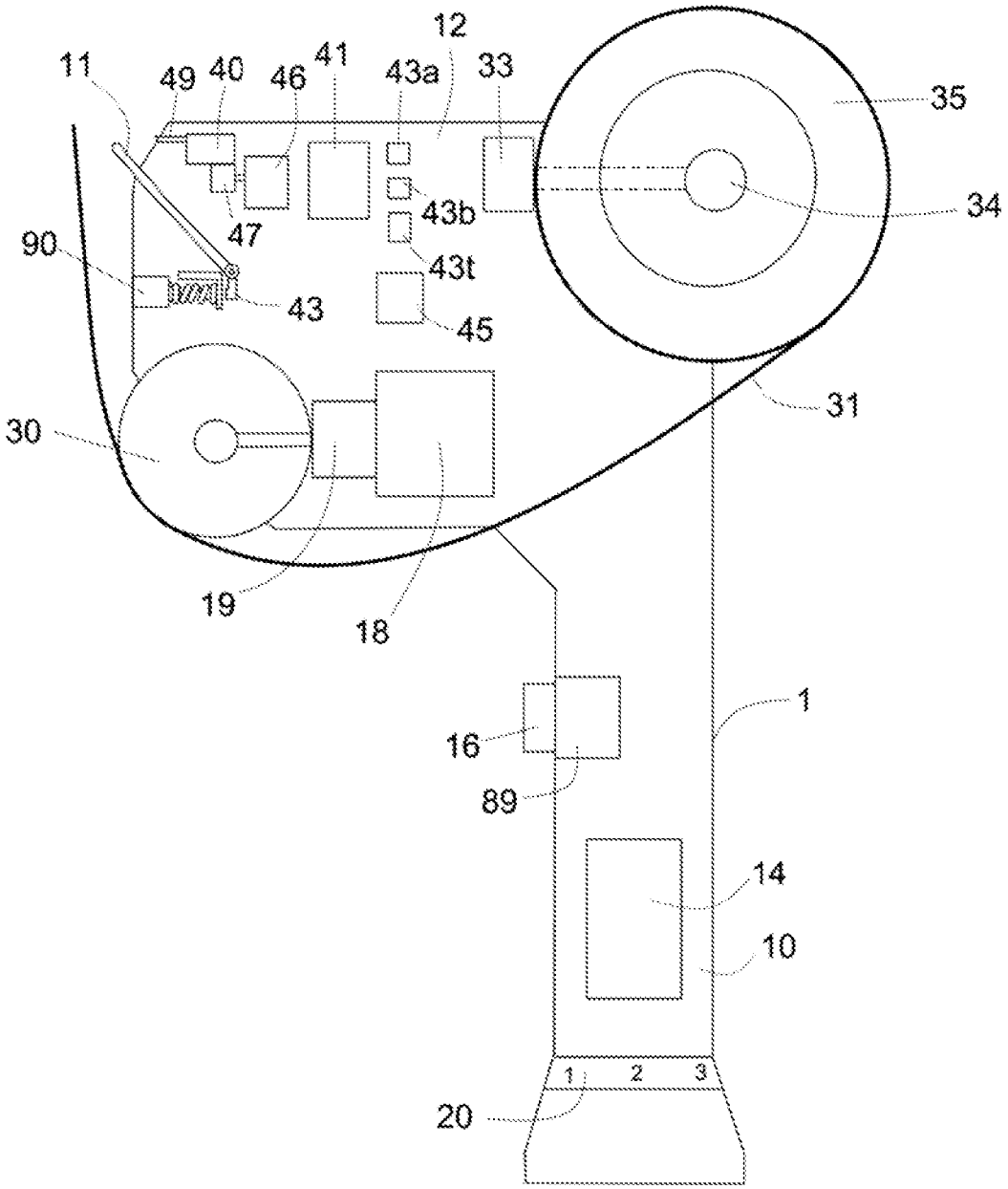
FIG. 3 is a schematic diagram of the tape dispenser according to an embodiment of present invention with its outer housing removed.
Figure 4A:
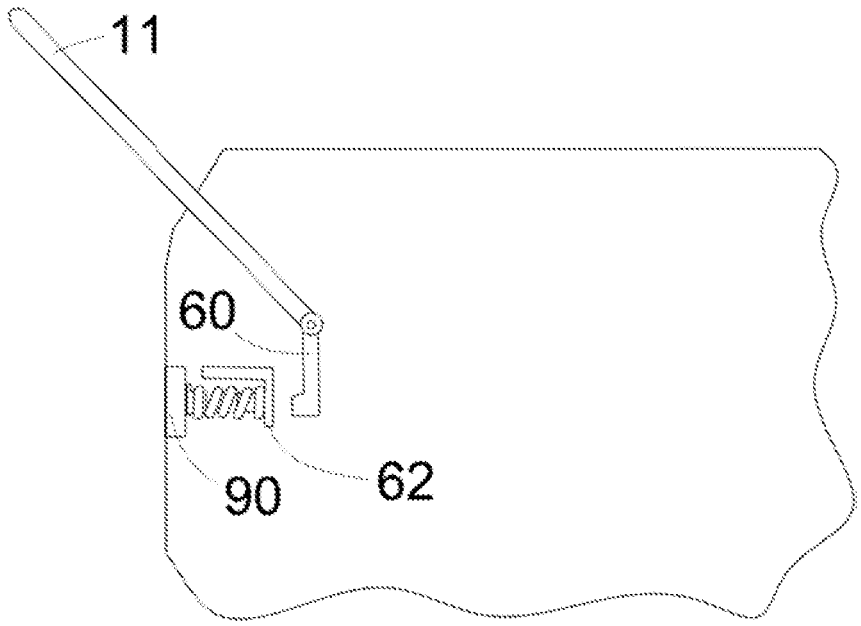
FIG. 4*a* is a partial view of tape dispenser of present invention, showing the lever and switch components.
Figure 4B:
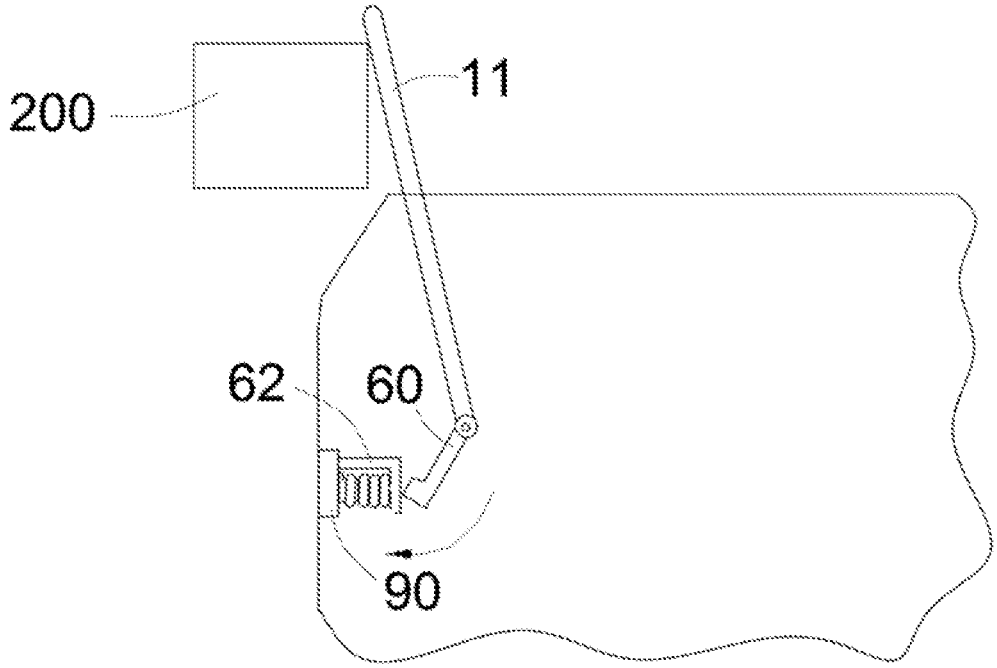
FIG. 4*b* is a partial view of tape dispenser of present invention, showing the lever, switch components and the interaction with an external object.

In another embodiment, lever 11 is the surface triggering device (see FIG. 3). In this case, the tension loaded lever 11 is mounted with respected to the frame 12. One end of the lever 11 is fitted onto a conductive holder 60. FIG. 4*a* and FIG. 4*b* illustrate the operation. When the lever 11 is in contact with the surface of an object 200, lever 11 and the conductive holder 60 rotate clockwise and urge the conductive plate 62 against the spring and eventually it triggers switch 90. This closes the first portion of circuitry (switch 90 is setting to the "ON" position). In this case, the tape dispenser 1 is in standby mode. The user then engages the push button 16 located on the shaft of the handle. This, in turn, activates the electric switch 89 to form a complete closed circuit. When both switches (switch 90 and switch 89) of the electric circuits are set to "ON" position, electric motor 18 is activated to rotate its gears at the gear component 19, which drives the main roller 30 to pull the tape from the adapter roller 35. While the push button 16 remains engaged by the user, if the lever 11 is no longer in contact with the surface of an object, the conductive bolder 60 is passively retracted away from the conductive plate 62. The tension on the spring is thereby unloaded, forcing the conductive plate 62 to disconnect from the switch 90. In summary, the process of the lever 11 returning to its initial position causes the switch 90 to turn "OFF", which in turn, stops the motion of the motor 18. Conversely, the motor 18 will stop as well if the user releases the push button 16 while the lever 11 still in contact with the surface of an object. This dual-switch circuit ensures that electric components such as motor 18 will not win on unexpectedly when user accidentally depresses the lever 11 or the push button 16.

When the desired length of tape has been achieved, tape 31 can be cut off by a powered cutter 40 with blade 49. The operation of cutter 40 is managed by cutter circuit controller 41 as discussed above. The inputs of cutter circuit controller 41 are connected to contact 43*a*, contact 43*b* and contact 43*t* respectively. Contact 43*a* is further connected to switch 90 of the lever 11. Contact 43*b* is connected to the switch 89 of the push button 16. Contact 43*t* is connected to timer 45, a digital counter which counts down from a specified time.

It is to be noted that the conductive holder 60 can be part of the lever 11 as one entity. It is to be noted that surface triggering device such as lever 11 can be of various designs, sizes and shapes (such as knob, tab, stub, lever, disk or button) as long as it causes the switch to turn on and off. Note that the lever 11 can also be part of the electrical switch as one entity.

Figure 5:
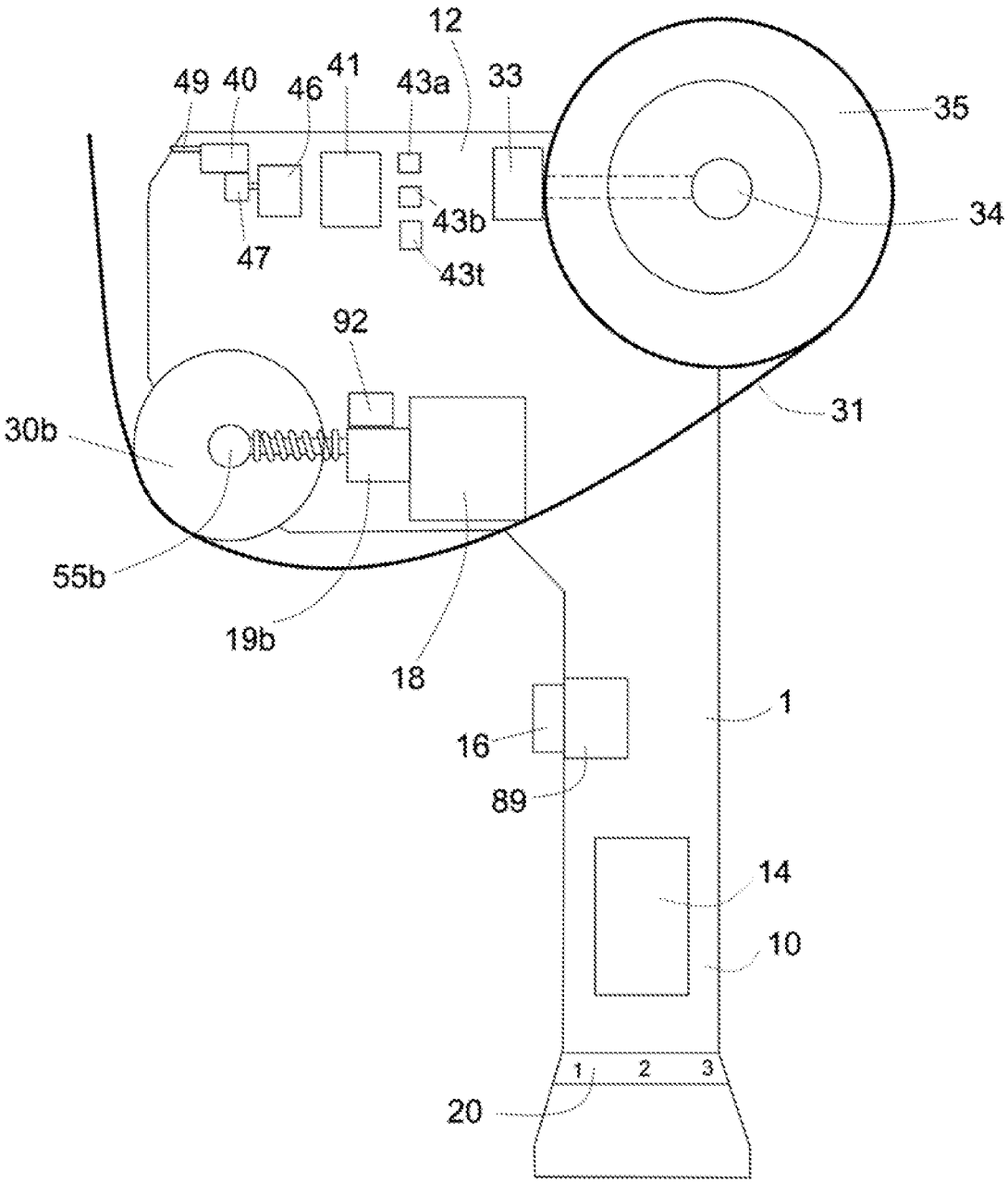
FIG. 5 is a schematic diagram of the tape dispenser according to an embodiment of present invention with its outer housing removed.
Figure 6A:
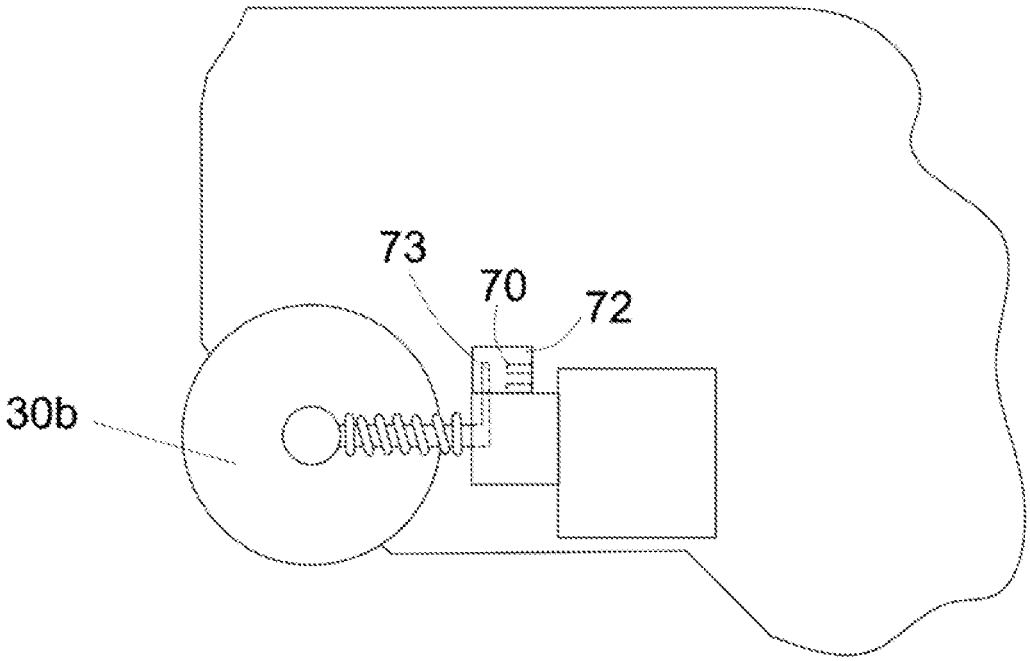
FIG. 6*a* is a partial view of tape dispenser of present invention, showing the main roller and switch components.
Figure 6B:
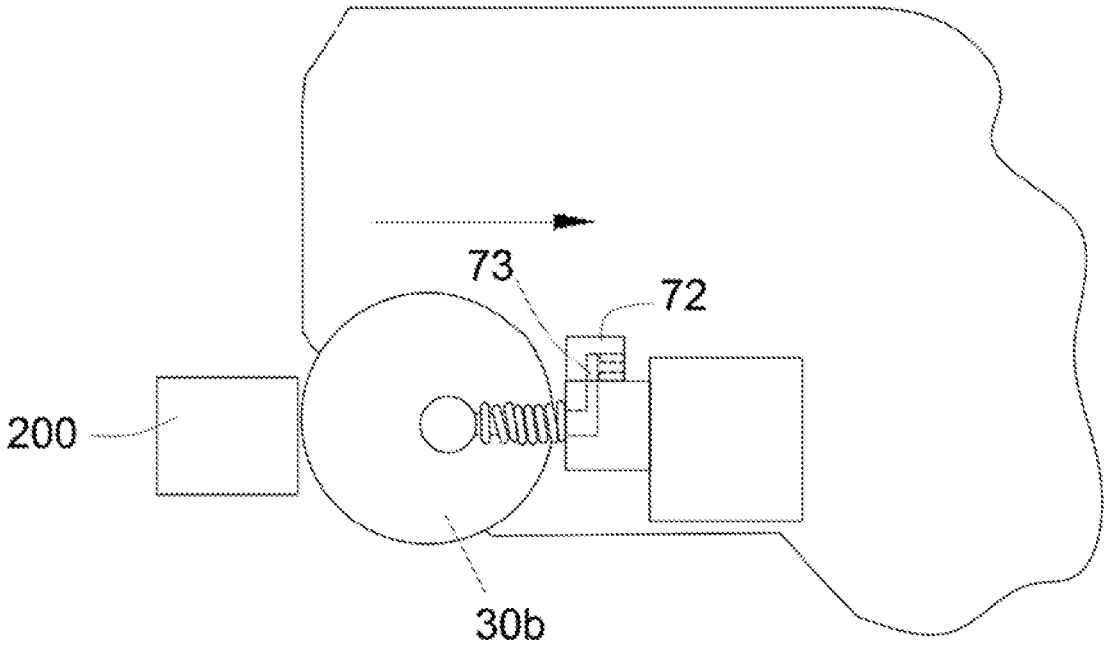
FIG. 6*b* is a partial view of tape dispenser of present invention, showing the main roller, switch components and the interaction with an external object.

In another embodiment, the electrical switching device now is integrated into the component of main roller 30*b* of tape dispenser 1 (See FIG. 5). In this case, the main roller 30*b* is connected to the tension loaded gear component 19*b* by the axle 55*b*. FIG. 6*a* and FIG. 6*b* illustrate the operation, during the taping process, the user places tape dispenser 1 on the surface of an object 200 such as a carton box. The pressure asserted on tape dispenser 1 will result in the main roller 30*b* retracted and urged into a position against the spring and eventually its conductive plate 73 comes into contact with the conductive plates 70 of the switch 72, closing the first portion of circuitry (switch 72 is in "ON" position). In this case, the tape dispenser 1 is in standby mode. The user then engages the push button 16 located on the shaft of the handle. This, in turn, closes electric switch 89 to form a complete circuit. When both switches (switch 72 and switch 89) of the are set to "ON" position, powered by battery 14, the electric motor 18 activates and rotates its gears at the gear component 19*b*, which drives the main roller 30*b* to pull the tape 31 from the adapter roller 35. While the push button 16 remains depressed, if the main roller 30*b* is no longer in contact with the surface of an object, the spring automatically returns the main roller 30*b* to its initial "unpressed" position (switch 72 is in "OFF" position) forming an open circuit and causing the motion of the motor 18 to stop. If the user releases the push button 16 while the main roller 30*b* still in contact with the surface of an object, the motor 18 will stop as well. The said dual-switch circuit ensures the electric components such as motor 18 will not turn on unexpectedly when the user accidentally triggers the switch of either main roller 30*b* or push button 16.

When the desired length of the tape 31 has been dispensed, tape 31 can be cut off by a powered cutter 40 with blade 49. The operation of cutter 40 is managed by cutter circuit controller 41 as discussed above. The inputs of cutter circuit controller 41 are connected to contact 43*a*, contact 43*b* and contact 43*t* respectively. Contact 43*a* is further connected to switch 72 of the main roller 30*b*. Contact 43*b* is connected to the switch 89 of the push button 16. Contact 43*t* is connected to timer 45, a digital counter which counts down from a specified time.

The main roller 30*b* or push button 16 can be of various designs, sizes and shapes (such as knob, tab, stub, lever, disk or button) as long as it causes the switch to turn on and off. Note that, main roller 30*b* or push button 16 can also be part of the electrical switch as one entity.

Figure 7:
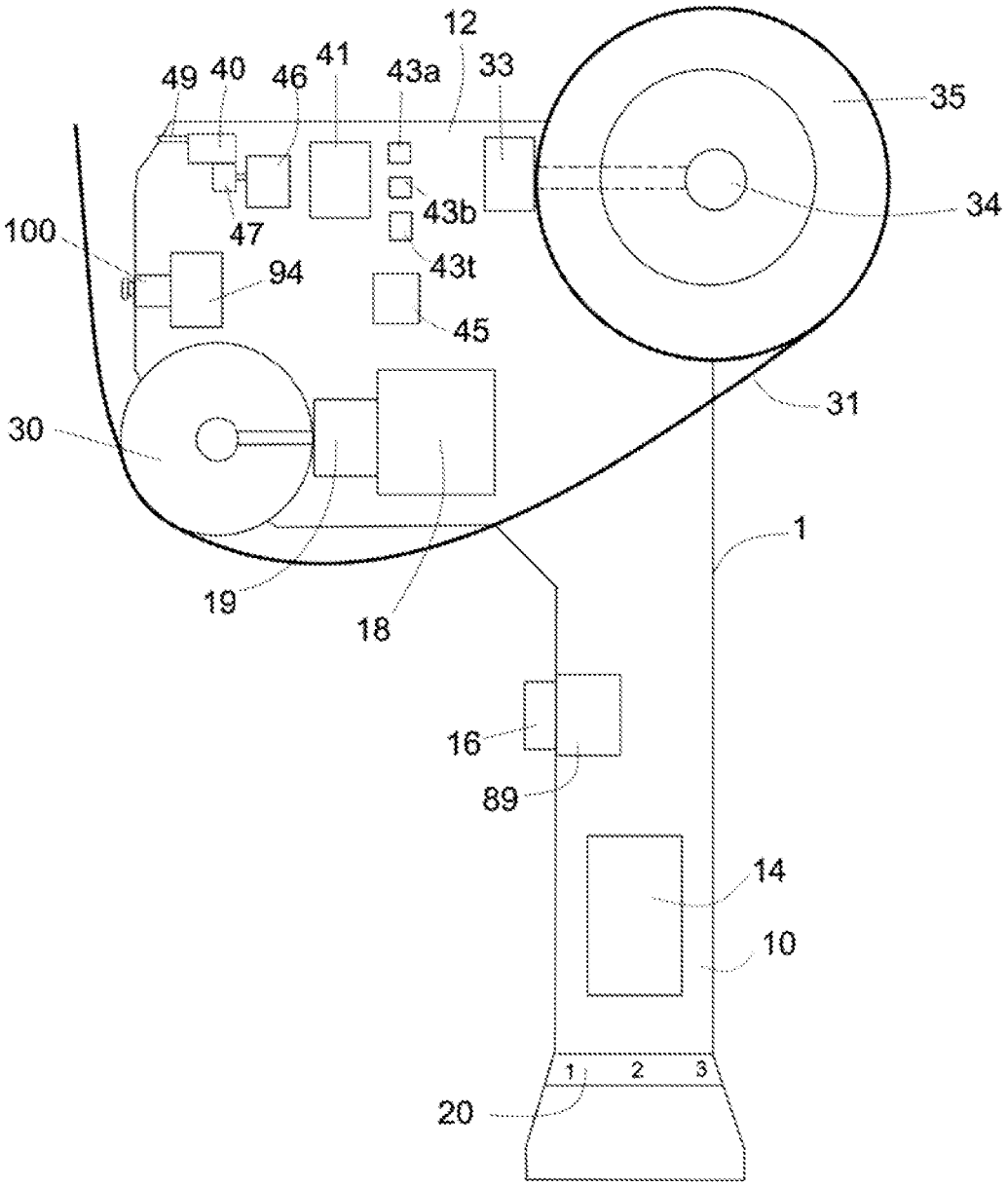
FIG. 7 is a schematic diagram of the tape dispenser according to an embodiment of present invention with its outer housing removed.

In another embodiment, the surface triggering device can be a proximity sensor 100 (See FIG. 7). A proximity sensor is a sensor able to detect the presence of nearby objects without any physical contact. The proximity sensor can be triggered by electromagnetic or light source such as infrared. In this case, the proximity sensor 100 is mounted with respected to the frame 12. When the sensor of tape dispenser 1 is in within specific range to target object, a detection of object surface by the proximity sensor 100 will activate the electric switch 94 into "ON" position and complete the first portion of the circuit. The secondary circuit will be closed when the user presses the roller push button 16. When both switches of the electric circuits are set to "ON" position, electric motor 18 is activated to rotate its gears at the gear component 19, which drives the main roller 30 to pull the tape from the adapter roller 35. While the push button 16 remains depressed on by the user, if the tape dispenser is moved away from the target object, the proximity sensor will deactivate the switch 94, causing an open circuit which in turn stopping the motion of the motor 18. The motor 18 will stop as well if the user let go the push button 16 while the target object is still within the proximity of the electronic proximity sensor. This will ensure that the electric motor 18 will not turn on unexpectedly when user accidentally activated the primary switch. When the tape 31 has dispensed to a desired length, tape 31 can be cut of by a powered cutter 40 with blade 49. The operation of cutter 40 is managed by cutter circuit controller 41 as discussed above. The inputs of cutter circuit controller 41 are connected to contact 43*a*, contact 43*b* and contact 43*t* respectively. Contact 43*a* is further connected to switch 94 of the proximity sensor 100. Contact 43*b* is connected to the switch 89 of the push button 16. Contact 43*t* is connected to timer 45, a digital counter which counts down from a specified time. The proximity sensor can vary in all kind of shapes, designs or functions as long as its main purpose is to activate the circuit. It is to be notes that the proximity sensor can be replaced by a proximity switch; in this case the switch 94 is omitted. The proximity switch will open or close an electrical circuit when it makes contact with or comes within a certain distance of an object.

It is to be understood that the invention is not limited in its application to the details of construction and the arrangement of the components set forth in the following description and illustrated in the drawings. The invention is capable of other embodiments or being practiced or carried out in various ways. Also, it is to be understood that the phraseology and terminology employed herein is for the purpose of description and should not be regarded as limiting.

The invention claimed is:

1. A hand-held power tape dispenser comprising:

(a) a first motor and a second motor;

(b) at least one rotatable roller operably connected to the first motor and configured to pull tape from at least one adapter roller;

(c) a surface triggering device configured to trigger a first switch and a main triggering device configured to trigger a second switch; and, (d) at least one cutter member driven by the second motor, wherein:

in a first mode associated with an off state of the first motor, the surface triggering device is coupled to a spring and in an extended position to open the first switch and the main triggering device is not activated to open the second switch;

in a second mode associated with a standby state of the first motor, either: (1) the surface triggering device is urged against the spring and in a retracted position to close the first switch and the main triggering device is not activated to open the second switch or (2) the surface triggering device is in the extended position to open the first switch and the main triggering device is activated to close the second switch; and, in a third mode associated with an energized state of the first motor, the surface triggering device is in a retracted position to close the first switch and the main triggering device is activated to close the second switch, wherein in the energized state, the first motor is energized one of the at least one motor to effectuate dispensing of tape.

2. The hand-held power tape dispenser according to claim 1, further comprising an electrical circuit operably coupled to control the second motor, wherein a path of the electrical circuit is opened or closed by at least one of the first switch and the second switch, such that the second motor is responsive to at least one of the first switch and the second switch.

3. The hand-held power tape dispenser according to claim 1, wherein the surface triggering device comprises at least one tension loaded mechanical component.

4. The hand-held power tape dispenser according to claim 3, wherein the surface triggering device comprises the at least one rotatable roller.

5. The hand-held power tape dispenser according to claim 1, wherein the least one rotatable roller is in a driven relationship responsive to the first motor.

6. The hand-held power tape dispenser according to claim 1, further comprising at least one cutter controller operably coupled with the surface triggering device and the main triggering device via the first switch and the second switch, such that the at least one cutter member is responsive to at least one of the first switch and the second switch.

7. The hand-held power tape dispenser of claim 1, wherein the surface triggering device comprises the at least one rotatable roller.

8. A hand-held power tape dispenser comprising:

(a) at least one handle, and a frame supported by the handle;

(b) an electrical circuit;

(c) a first motor and a second motor operably coupled to the electrical circuit;

(d) at least one rotatable roller operably connected to the first motor and configured to pull tape from at least one adapter roller;

(e) a surface triggering device configured to trigger a first switch and a main triggering device configured to trigger a second switch, wherein a path of the electrical circuit is opened or closed by at least one of the first switch and the second switch, such that the second motor is responsive to at least one of the first and the second switch;

(f) at least one cutter member attached to the frame, wherein:

in a first mode associated with an off state of the first motor, the surface triggering device is coupled to a spring and in an extended position to open the first switch and the main triggering device is not activated to open the second switch;

in a second mode associated with a standby state of the first motor, either: (1) the surface triggering device is urged against the spring and in a retracted position to close the first switch and the main triggering device is not activated to open the second switch, or (2) the surface triggering device is in the extended position to open the first switch and the main triggering device is activated to close the second switch; and, in a third mode associated with an energized state of the first motor, the surface triggering device is in a retracted position to close the first switch and the main triggering device is activated to close the second switch, wherein in the energized state, the first motor is energized one of the at least one motor to effectuate dispensing of tape.

9. The hand-held power tape dispenser according to claim 8, wherein the at least one adapter roller is operably coupled to a third motor.

10. The hand-held power tape dispenser according to claim 8, further comprising:

at least one cutter circuit controller configured to engage with at least one of the first switch and the second switch in a first switching position and a second switching position, and operably coupled with the surface triggering device and the main triggering device, such that the at least one cutter member is responsive to at least one of the first switch and the second switch.

11. The hand-held power tape dispenser of claim 8, wherein the surface triggering device comprises a main roller of the at least one rotatable roller.

12. The hand-held power tape dispenser of claim 11, wherein the main triggering device comprises a push button disposed on the at least one handle.

13. A hand-held power tape dispenser comprising:

(a) at least one electrical circuit;

(b) a first motor and a second motor operably coupled to the electrical circuit;

(c) at least two on-off switches comprising a first switch and a second switch connected to the electrical circuit;

(d) a surface triggering device comprising a rotatable roller operably connected to the first motor and configured to pull the tape from at least one adapter roller, the surface triggering device and a main triggering device triggering the at least two on-off switches, wherein the first switch is operably coupled to the surface triggering device, and the second switch is operably coupled to the main triggering device;

(e) at least one cutter member driven by the second motor; and, (f) at least one cutter circuit controller engaging with at least one of the at least two on-off switches in a first switching position and a second switching position, and operably coupled with the surface triggering device and the main triggering device, such that the at least one cutter member is responsive to at least one of the first switch and the second switch, wherein:

in a first mode associated with an off state of the first motor, the surface triggering device is coupled to a spring and in an extended position to open the first switch and the main triggering device is not activated to open the second switch;

in a second mode associated with a standby state of the first motor, either: (1) the surface triggering device is urged against the spring in a retracted position to close the first switch and the main triggering device is not activated to open the second switch, or (2) the surface triggering device is in the extended position to open the first switch and the main triggering device is activated to close the second switch; and, in a third mode associated with an energized state of the first motor, the surface triggering device is in a retracted position to close the first switch and the main triggering device is activated to close the second switch, wherein in the energized state, the first motor is energized to effectuate dispensing of tape.

14. The hand-held power tape dispenser according to claim 13, wherein a path of the at least one electrical circuit is opened or closed by the at least two on-off switches.

15. The hand-held power tape dispenser according to claim 13, wherein the surface triggering device comprises at least one tension loaded mechanical component.

16. The hand-held power tape dispenser of claim 13, wherein the surface triggering device comprises a main roller of the at least one rotatable roller.

17. A hand-held power tape dispenser comprising:

(a) a motor;

(b) at least one rotatable roller operably connected to the first motor and configured to pull the tape from at least one adapter roller; and, (c) a surface triggering device a surface triggering device configured to trigger a first switch and a main triggering device configured to trigger a second switch wherein:

in a first mode associated with a off state of the motor, the surface triggering device is coupled to a spring and in an extended position to open the first switch and the main triggering device is not activated to open the second switch;

in a second mode associated with a standby state of the motor, either: (1) the surface triggering device is urged against the spring and in a retracted position to close the first switch and the main triggering device is not activated to open the second switch, or (2) the surface triggering device is in the extended position to open the first switch and the main triggering device is activated to close the second switch; and, in a third mode associated with an energized state of the motor, the surface triggering device is in a retracted position to close the first switch and the main triggering device is activated to close the second switch, wherein in the energized state, the motor is energized to effectuate dispensing of tape.

18. The hand-held power tape dispenser of claim 17, wherein the motor is in a driving relationship to at least one of the at least one rotatable roller.

19. The hand-held power tape dispenser of claim 17, wherein the main triggering device comprises a push button.

20. The hand-held power tape dispenser of claim 19, wherein the surface triggering device comprises a main roller of the at least one rotatable roller.

21. The hand-held power tape dispenser of claim 17, wherein the surface triggering device comprises a main roller of the at least one rotatable roller.

* * * * *